US008362976B2

(12) United States Patent
Lee

(10) Patent No.: US 8,362,976 B2
(45) Date of Patent: Jan. 29, 2013

(54) PLASMA DISPLAY DEVICE

(75) Inventor: Sang-Gu Lee, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 972 days.

(21) Appl. No.: 12/270,490

(22) Filed: Nov. 13, 2008

(65) Prior Publication Data

US 2009/0128538 A1 May 21, 2009

(30) Foreign Application Priority Data

Nov. 16, 2007 (KR) ..... 10-2007-0117505

(51) Int. Cl.
*G09G 3/28* (2006.01)

(52) U.S. Cl. ..... 345/37; 345/41; 345/60; 345/62; 315/169.3; 315/169.4

(58) Field of Classification Search ..... 345/62, 345/68, 37, 41, 60, 211, 215, 210; 315/169.3, 315/169.4

See application file for complete search history.

(56) References Cited

U.S. PATENT DOCUMENTS

| | | | | |
|---|---|---|---|---|
| 6,633,285 | B1 * | 10/2003 | Kigo et al. | 345/204 |
| 2006/0267873 | A1 * | 11/2006 | Chen et al. | 345/68 |
| 2007/0109228 | A1 * | 5/2007 | Lee et al. | 345/68 |

FOREIGN PATENT DOCUMENTS

| | | | |
|---|---|---|---|
| KR | 10-2001-0097045 | | 11/2001 |
| KR | 10-2005-0052196 | | 6/2005 |
| KR | 10-2006-0032632 | | 4/2006 |
| KR | 10-0573129 | * | 4/2006 |
| KR | 10-2006-0086768 | | 8/2006 |
| KR | 10-2006-0090052 | | 8/2006 |
| KR | 10-2006-0119613 | | 11/2006 |

OTHER PUBLICATIONS

Sedra, et al., Microelectronic Circuits, Holt Rinehart and Winston Inc., 2nd Ed. 1987, p. 591, Fig. 10.37.*

Korean Office action dated Mar. 12, 2009, for priority Korean application 10-2007-0117505, noting Korean publications KR 10-2005-0052196 and KR 10-2001-0097045 listed in this IDS.

Korean Office action dated Jun. 9, 2009, for priority Korean application 10-2007-0117505, noting listed references in this IDS.

* cited by examiner

*Primary Examiner* — Quan-Zhen Wang
*Assistant Examiner* — Michael J Eurice
(74) *Attorney, Agent, or Firm* — Christie, Parker & Hale, LLP

(57) ABSTRACT

A plasma display device that can utilize an energy recovery voltage regardless of whether pixels are selected. An energy recovery circuit of the plasma display device includes first and second switches serially coupled between a first voltage source and a second voltage source, a third switch coupled to a connection point between the first and second switches, a voltage recovery capacitor coupled between the third switch and a base voltage source, and a precharger for charging the voltage recovery capacitor.

13 Claims, 5 Drawing Sheets

PLASMA DISPLAY DEVICE

CROSS-REFERENCE TO RELATED APPLICATIONS

This application claims priority to and the benefit of Korean Patent Application No. 10-2007-0117505, filed on Nov. 16, 2007, in the Korean Intellectual Property Office, the entire content of which is incorporated herein by reference.

BACKGROUND OF THE INVENTION

1. Field of the Invention

The present invention relates to a plasma display device, and more particularly, to a plasma display device including a plasma display panel and an energy recovery circuit.

2. Description of the Related Art

A plasma display panel (PDP) of a plasma display device emits light from phosphors excited by ultraviolet (UV) rays generated during the discharge of an inert gas mixture to display an image. The plasma display device can be made thin and large and provides remarkably improved picture quality due to recently enhanced technologies. In particular, wall charges are accumulated on the surface of a three-electrode AC surface discharge plasma display device to protect the electrodes against sputtering generated by the discharge. Therefore, the three-electrode AC surface discharge plasma display device can be driven at a low voltage and has a long life.

Recently, a plasma display device with improved brightness and responsiveness has become available. A high voltage of about 200V is to be alternately applied from the sustain circuit of the plasma display device to the scan electrodes, the sustain electrodes, or the address electrodes of the plasma display device. Since capacitance exists between the electrodes, significant energy is lost to charge and discharge the capacitance. In order to solve the problem, an energy recovery circuit that includes an auxiliary inductor and an energy storage external capacitor is included in the plasma display device to reduce the amount of energy lost.

FIG. 1 is a schematic circuit diagram illustrating an energy recovery circuit included in a typical plasma display device.

Referring to FIG. 1, the energy recovery circuit generally includes a first switch SW1' to a fourth switch SW4', a voltage recovery capacitor Ca, and an inductor L.

The first switch SW1' is coupled between a panel capacitor Cp and the voltage recovery capacitor Ca to selectively transmit a 1/2 address voltage Va/2 to the panel capacitor Cp.

The second switch SW2' is coupled between the panel capacitor Cp and the voltage recovery capacitor Ca to selectively recover a voltage (e.g., a predetermined voltage) from the panel capacitor Cp to the voltage recovery capacitor Ca. The third switch SW3' is coupled between an address voltage Va source and the panel capacitor Cp to selectively transmit the address voltage Va to the panel capacitor Cp.

The fourth switch SW4' is coupled between the panel capacitor Cp and a base voltage GND to selectively apply the base voltage GND to the panel capacitor Cp.

The voltage recovery capacitor Ca is coupled between a connection point between the first switch SW1' and the second switch SW2' and the base voltage GND. The voltage recovery capacitor Ca transmits a voltage (e.g., a predetermined voltage) to the panel capacitor Cp through the first switch SW1' or recovers a voltage (e.g., a predetermined voltage) from the panel capacitor Cp through the second switch SW2'. Here, the 1/2 address voltage Va/2 is charged in the voltage recovery capacitor Ca.

The inductor L is coupled between another connection point between the first switch SW1' and the second switch SW2' and the panel capacitor Cp. The inductor L forms a resonance circuit together with the panel capacitor Cp.

The operation of the energy recovery circuit having the above described structure will be described as follows.

First, when the first switch SW1' is turned on, the potential of the address electrode A increases to the address voltage Va due to the resonance of the panel capacitor Cp and the inductor L.

Then, when the third switch SW3' is turned on, the potential of the address electrode A is sustained as the address voltage Va. When the second switch SW2' is turned on, the potential of the address electrode A is reduced to the level of the base voltage GND due to the resonance of the panel capacitor Cp and the inductor L. Then, the fourth switch SW4' is turned on, and the potential of the address electrode A is sustained as the level of the base voltage GND.

In the energy recovery circuit included in the above-described plasma display device, when a power source is supplied to initialize the plasma display device, charge corresponding to the 1/2 address voltage Va/2 is not charged in the voltage recovery capacitor Ca. In addition, in the pixels that are not selected in a previous step, the 1/2 address voltage Va/2 is not charged in the voltage recovery capacitor Ca.

When the first switch SW1' is turned on in a state where the 1/2 address voltage Va/2 is not charged in the voltage recovery capacitor Ca, the potential of the address electrode A increases to a potential lower than the address voltage Va.

Then, when the third switch SW3' is turned on, the address voltage Va is applied to the address electrodes A. Here, since a difference between the applied address voltage Va and the voltage at the address electrodes A is large, the amount of inrush current rapidly increases. Therefore, the maximum value of the voltage applied to the address electrodes A increases rapidly as well. Here, the abnormal maximal voltage may be larger than the withstand voltages of the switches SW1'-4' or the diodes that constitute the energy recovery circuit, therefore the switches SW1'-4' or the diodes may not operate normally.

In order to solve the above-described problem, a structure in which the voltage recovery capacitor is charged faster during the initial driving of the plasma display device so that the voltage peak of the electrodes is removed and that the plasma display device is stably driven is disclosed in Korean Publication No. 20060086768.

However, in a method of precharging the voltage recovery capacitor during the initial driving of the plasma display device using resistance distribution as illustrated in the Korean Publication No. 20060086768, charging time is long so that a circuit operation is slow. In addition, although the resistance of the energy recovery circuit can be reduced in order to reduce the charging time, power consumption is increased. That is, in the energy recovery circuit published in the Korean Publication No. 20060086768, the power consumption and the heat dissipation increase as the charging time becomes shorter.

SUMMARY OF THE INVENTION

Accordingly, it is an aspect of the present invention to provide a plasma display device including an energy recovery circuit to reduce heat dissipation and power consumption, and a method of driving the same.

According to embodiments of the present invention, there is provided a plasma display device including an energy recovery circuit. The energy recovery circuit includes first and second switches serially coupled between a first voltage source and a second voltage source, a third switch coupled to a connection point between the first and second switches, a voltage recovery capacitor coupled between the third switch and a base voltage source, a first resistor and a second resistor serially coupled between the first voltage source and a third voltage source to form a voltage distribution circuit, a fourth switch having a control electrode coupled to a connection point between the first resistor and the second resistor, the fourth switch coupled between the first voltage source and the voltage recovery capacitor, and a third resistor coupled between the first voltage source and the fourth switch.

According to another embodiment of the present invention, there is provided a plasma display device including an energy recovery circuit. The energy recovery circuit includes first and second switches serially coupled between a first voltage source and a second voltage source, a third switch coupled to a connection point between the first and second switches, a voltage recovery capacitor coupled between the third switch and a base voltage source, a first resistor coupled between the first voltage source and the voltage recovery capacitor, and a Zener diode coupled between the voltage recovery capacitor and the second voltage source. The voltage recovery capacitor is maintained charged at a voltage.

According to still another embodiment of the present invention, there is provided a plasma display device including an energy recovery circuit. The energy recovery circuit includes first and second switches serially coupled between a first voltage source and a second voltage source, a third switch coupled to a connection point between the first and second switches, a voltage recovery capacitor coupled between the third switch and a base voltage source, a first resistor coupled between the first voltage source and the voltage recovery capacitor, and a second resistor coupled between the voltage recovery capacitor and the second voltage source.

According to yet another embodiment of the present invention, there is provided a plasma display device including an energy recovery circuit. The energy recovery circuit includes first and second switches serially coupled between a first voltage source and a second voltage source, a third switch coupled to a connection point between the first and second switches, a voltage recovery capacitor coupled between the third switch and a base voltage source, and a precharger coupled to a connection point between the third switch and the voltage recovery capacitor.

BRIEF DESCRIPTION OF THE DRAWINGS

These and/or other embodiments and features of the present invention will become apparent and more readily appreciated from the following description of certain exemplary embodiments, taken in conjunction with the accompanying drawings of which.

DETAILED DESCRIPTION OF EXEMPLARY EMBODIMENTS

Figure 1:
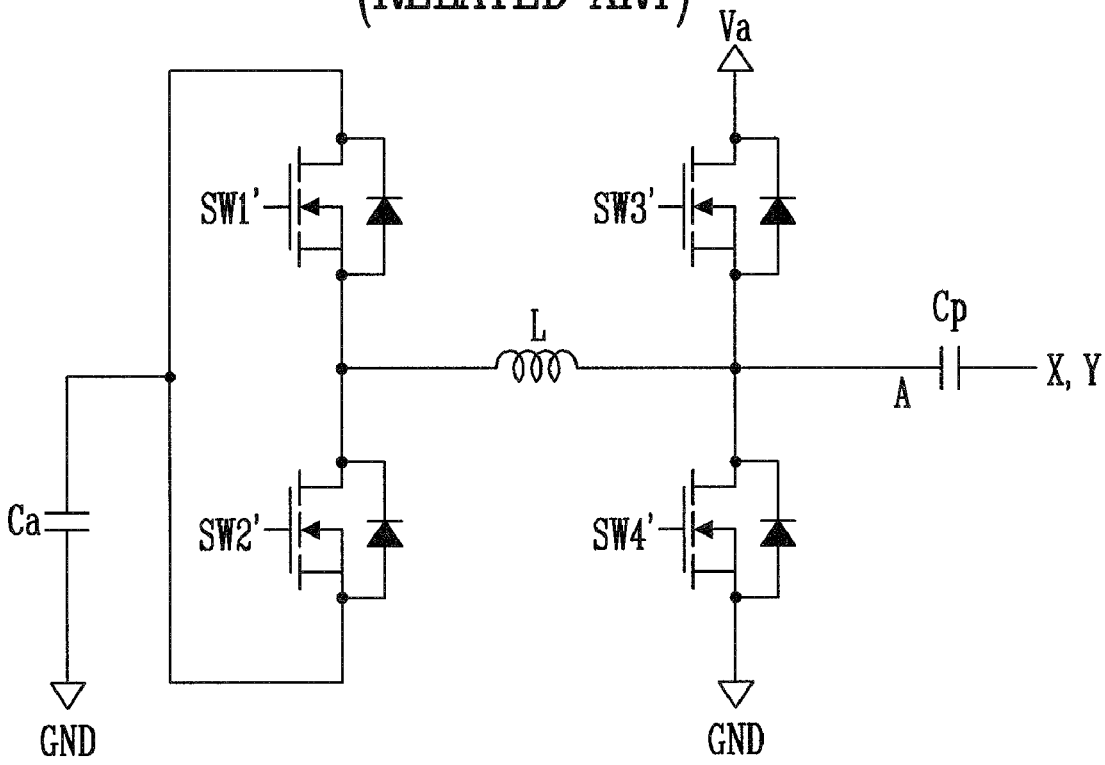
FIG. 1 (RELATED ART)
FIG. 1 is a schematic circuit diagram of an energy recovery circuit included in a conventional plasma display device.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the present invention are omitted for clarity. Also, like reference numerals refer to like elements throughout.

Figure 2:
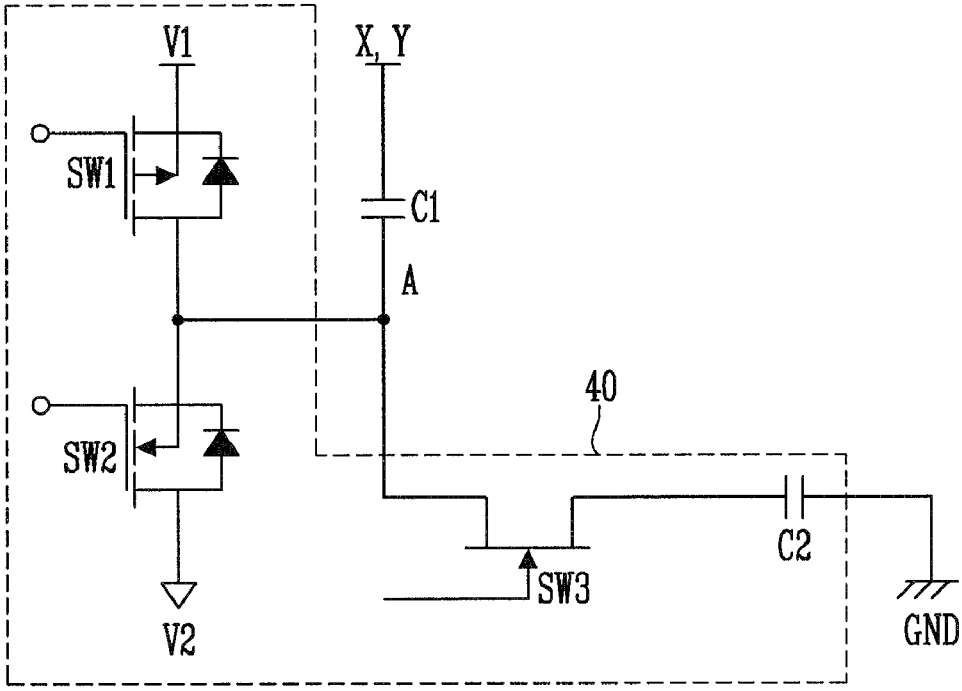
FIG. 2 is a schematic circuit diagram of an energy recovery circuit according to an embodiment of the present invention.
Figure 3:
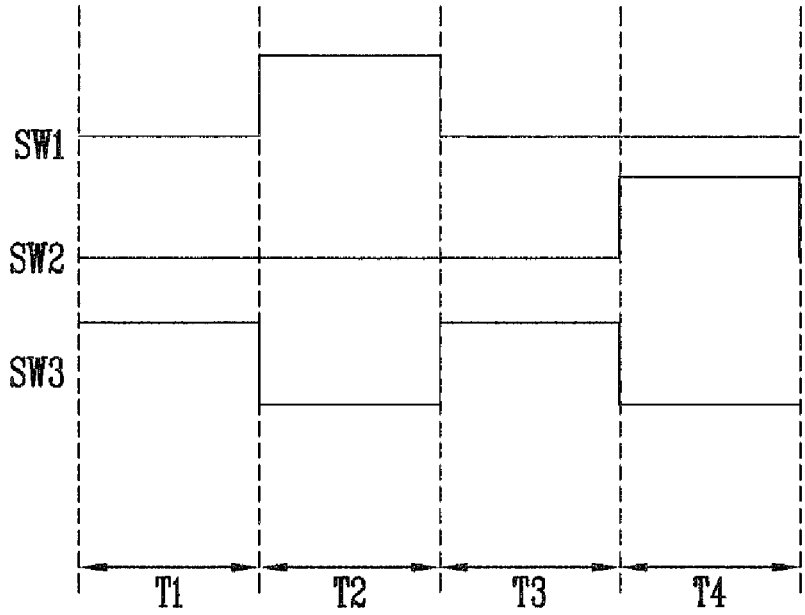
FIG. 3 is a timing diagram for illustrating the operation of the energy recovery circuit shown in FIG. 2.
Figure 4A:
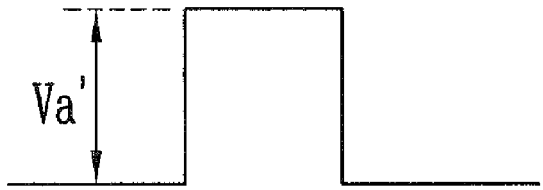
FIG. 4A is an address output waveform of a conventional energy recovery circuit.
Figure 4B:
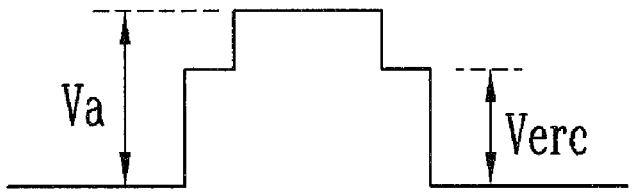
FIG. 4B is an address output waveform of an energy recovery circuit according to an embodiment of the present invention.

FIG. 2 is a schematic circuit diagram of an energy recovery circuit according to an embodiment of the present invention. FIG. 3 is a timing diagram for illustrating the operation of the energy recovery circuit shown in FIG. 2. FIG. 4A is an address output waveform of a conventional energy recovery circuit, and FIG. 4B is an address output waveform of an energy recovery circuit according to an embodiment of the present invention.

Referring to FIGS. 2 to 4B, a plasma display device according to an embodiment of the present invention includes energy recovery circuits 40 and a first capacitor C1.

The first capacitor C1 represents a parasitic capacitance, that is, a panel capacitor between scan electrodes Y or sustain electrodes X and address electrodes A. That is, according to the embodiment, the first capacitor C1 is repeatedly charged and discharged using a voltage (e.g., a predetermined voltage) to display an image.

The energy recovery circuits 40 are coupled to the scan electrodes Y or the sustain electrodes X and the address electrodes A, respectively, to supply an address voltage Va to the first capacitor C1. The energy recovery circuits 40 coupled to the scan electrodes Y or the sustain electrodes X and the address electrodes A, respectively, are symmetrical with each other. Therefore, referring to FIG. 2, one of the energy recovery circuits 40 coupled to the address electrodes A will be described.

The energy recovery circuit 40 includes a second capacitor C2, a first switch SW1, a second switch SW2 and a third switch SW3.

The second capacitor C2 is coupled between the first capacitor C1 and a base voltage source GND. The second capacitor C2 recovers a voltage (e.g., a predetermined voltage) from the first capacitor C1 or transmits the recovered voltage to the first capacitor C1 in accordance with the operation of the third switch SW3.

The first switch SW1 is coupled between the first voltage V1 source and the first capacitor C1 to selectively transmit the first voltage V1 to the first capacitor C1.

The second switch SW2 is coupled between the first capacitor C1 and a second voltage V2 source to selectively transmit the second voltage V2 to the first capacitor C1.

The third switch SW3 is coupled between the first capacitor C1 and the second capacitor C2. The third switch SW3 selectively transmits a voltage (e.g., a predetermined voltage) to the first capacitor C1 or selectively transmits a voltage (e.g., a predetermined voltage) stored in the first capacitor C1 to the second capacitor C2.

The operation of the above-described energy recovery circuit 40 will be described with reference to FIG. 3. It is assumed that an energy recovery voltage Verc is previously stored in the second capacitor C2 in a previous step.

First, in a first period T1, the first switch SW1 and the second switch SW2 are turned off, and the third switch SW3 is turned on. Therefore, a current path through the second capacitor C2, the third switch SW3 and the first capacitor C1 is formed. Therefore, the energy recovery voltage Verc applied from the second capacitor C2 is charged in the first capacitor C1.

Then, in a second period T2, the third switch SW3 is turned off, and the first switch SW1 is turned on. Therefore, a current path through the first voltage V1 source, the first switch SW1 and the first capacitor C1 is formed. Therefore, the first voltage V1 from the first voltage V1 source is charged in the first capacitor C1 where the energy recovery voltage Verc is charged.

In a third period T3, the first switch SW1 is turned off, and the third switch SW3 is turned on. Therefore, a current path through the first capacitor C1, the third switch SW3 and the second capacitor C2 is formed. Therefore, a voltage (e.g., a predetermined voltage) charged in the first capacitor C1 is recovered to the second capacitor C2.

Then, in a fourth period T4, the first switch SW1 and the third switch SW3 are turned off, and the second switch SW2 is turned on. Therefore, a current path through the first capacitor C1, the second switch SW2 and the second voltage V2 source is formed. Therefore, the voltage charged in the first capacitor C1 is reduced to the level of the second voltage V2.

Referring to FIGS. 4A and 4B, the plasma display device recovers a part of the voltage charged in the first capacitor C1 to the second capacitor C2 in an Nth energy recovery step and applies the recovered voltage to the first capacitor C1 before an (N+1)th address voltage. Therefore, it is not necessary to excessively apply the address voltage at the highest level. That is, the address voltage is applied at a level obtained by subtracting the energy recovery voltage Verc from the highest level of the address voltage, thus power consumption is reduced. However, the address voltage is not applied in pixels (not shown) that are not selected in the Nth energy recovery step. Therefore, when the (N+1)th address voltage is applied to the non-selected pixels, the address voltage is applied at the highest level.

Figure 5:
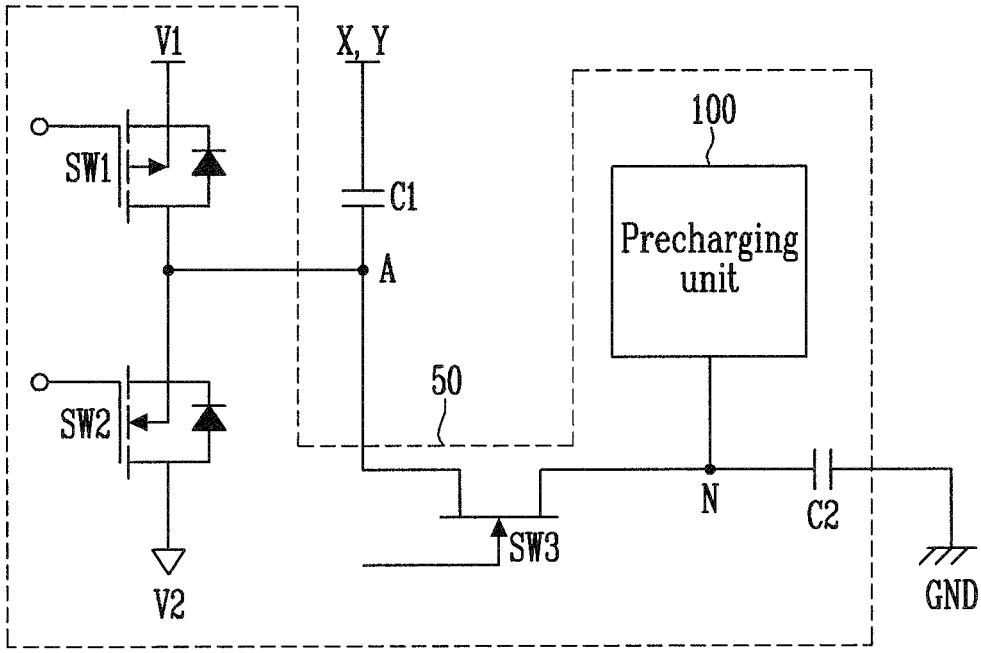
FIG. 5 is a schematic circuit diagram of an energy recovery circuit according to another embodiment of the present invention.

FIG. 5 is a schematic circuit diagram of an energy recovery circuit according to another embodiment of the present invention.

In FIG. 5, the first capacitor C1 represents parasitic capacitance, that is, a panel capacitor between scan electrodes Y or sustain electrodes X and address electrodes A. That is, according to the present embodiment, the first capacitor C1 is repeatedly charged and discharged using a voltage (e.g., a predetermined voltage) to display an image.

Energy recovery circuits 50 are coupled to the scan electrodes Y or the sustain electrodes X and the address electrodes A, respectively, to supply an address voltage Va to the first capacitor C1. The energy recovery circuits 50 coupled to the scan electrodes Y or the sustain electrodes X and the address electrodes A, respectively, are symmetrical with each other. Therefore, referring to FIG. 5, one of the energy recovery circuits 50 coupled to the address electrodes A will be described.

The energy recovery circuit 50 includes a second capacitor C2, a first switch SW1, a second switch SW2, a third switch SW3 and a precharger 100.

The second capacitor C2 is coupled between the first capacitor C1 and a base voltage source GND. The second capacitor C2 recovers a voltage (e.g., a predetermined voltage) from the first capacitor C1 or transmits the recovered voltage to the first capacitor C1 in accordance with the operation of the third switch SW3.

The first switch SW1 is coupled between the first voltage V1 source and the first capacitor C1 to selectively transmit the first voltage V1 to the first capacitor C1.

The second switch SW2 is coupled between the first capacitor C1 and a second voltage V2 source to selectively transmit the second voltage V2 to the first capacitor C1.

The third switch SW3 is coupled between the first capacitor C1 and the second capacitor C2. The third switch SW3 selectively transmits a voltage (e.g., a predetermined voltage) to the first capacitor C1 or selectively transmits a voltage (e.g., a predetermined voltage) stored in the first capacitor C1 to the second capacitor C2.

The precharger 100 is coupled to a connection point between the third switch SW3 and the second capacitor C2 so that the energy recovery voltage Verc is maintained in the second capacitor C2.

In the energy recovery circuit 50, the energy recovery voltage Verc is continuously applied to a node N positioned between the third switch SW3 and the second capacitor C2. That is, according to an embodiment of the present invention described with reference to FIG. 2, the address voltage Va is not applied to the pixels that are not selected in the Nth step so that the energy recovery voltage Verc cannot be charged in the second capacitor C2. Therefore, when the pixels are selected in the (N+1)th step, the third switch SW3 is turned on regardless of whether the energy recovery voltage Verc is charged in the second capacitor C2. Therefore, no voltage is applied in the first capacitor C1.

However, according to the embodiment shown in FIG. 5, the precharger 100 continuously applies the energy recovery voltage Verc to the second capacitor C2 regardless of whether the pixels are selected in a previous step. Therefore, before the address voltage Va is applied to the first capacitor C1, the second capacitor C2 can be previously charged to the energy recovery voltage Verc level. Therefore, the address voltage Va can be stably applied to the first capacitor C1.

Since the other operations of the energy recovery circuit 50 besides the precharging operation according to the embodiment shown in FIG. 5 are the same as in the embodiment described with reference to FIG. 2, description thereof will be omitted.

Figure 6:
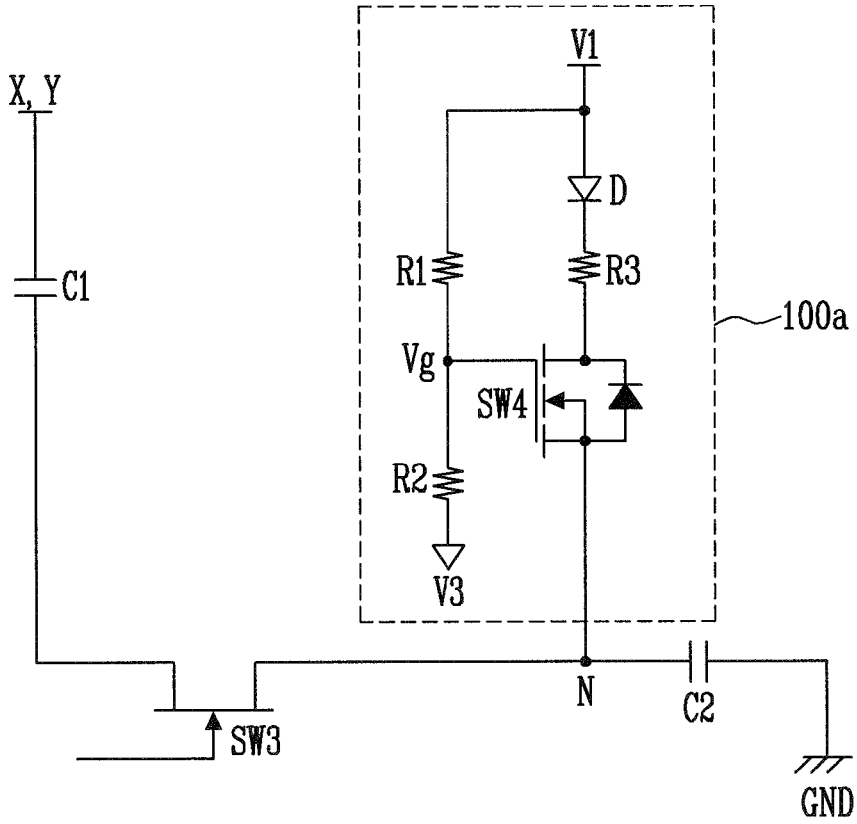
FIG. 6 is a schematic circuit diagram illustrating a precharger according to an embodiment of the present invention.

FIG. 6 is a schematic circuit diagram illustrating a precharger 100*a* according to an embodiment of the present invention.

The first capacitor C1, the second capacitor C2 and the third switch SW3 illustrated in FIG. 6 have the same structure as those in the circuit of FIG. 5.

The precharger 100*a* according to an embodiment includes a first resistor R1, a second resistor R2, a third resistor R3, a fourth switch SW4 and a diode D.

The first resistor R1 and the second resistor R2 are serially coupled between the first voltage V1 source and the third voltage V3 source. A gate voltage Vg is applied through the first resistor R1 and the second resistor R2 to turn on the fourth switch SW4.

The fourth switch SW4 is coupled between the first voltage V1 source and the second capacitor C2, and the control electrode of the fourth switch SW4 is coupled to a connection point between the first resistor R1 and the second resistor R2. The fourth switch SW4 forms a current path including the first voltage V1 source, the third resistor R3 and the second capacitor C2. The fourth switch SW4 receives the gate voltage Vg that is provided by a voltage divider including the first resistor R1 and the second resistor R2. The gate voltage Vg applied to the fourth switch SW4 can be controlled using a ratio of the resistance of the first resistor R1 to the resistance of the second resistor R2 as illustrated in Equation 1.

$$Vg=V1*R2/(R1+R2)$$

$$Verc=Vg-Vth \text{ (}Vth\text{: threshold voltage of } SW4\text{)}$$

$$\text{Given } Vth=0,\ Verc=Vg$$

$$Verc=V1*R2(R1+R2) \qquad \text{EQUATION 1}$$

In the EQUATION 1, Verc represents an energy recovery voltage transmitted to the node N through the fourth switch SW4 that is turned on by the gate voltage Vg. In addition, Vg represents a voltage applied to the gate of the fourth switch SW4, and R1 and R2 represent a first resistor and a second resistor included in a voltage divider circuit for voltage distribution.

According to EQUATION 1, the voltage level of the energy recovery voltage Verc can be varied by controlling the value of the first resistor R1 and the value of the second resistor R2. That is, when the energy recovery voltage Verc is smaller than the gate voltage Vg, the fourth switch SW4 is turned on. Therefore, the second capacitor C2 charged with the energy recovery voltage Verc is charged by the first voltage V1 source until the voltage charged at the second capacitor increases from the energy recovery voltage Verc to the gate voltage Vg. Therefore, the energy recovery voltage Verc can always be maintained at the gate voltage Vg level.

When the energy recovery voltage Verc is larger than the gate voltage Vg, the fourth switch SW4 is turned off to maintain the energy recovery voltage Verc.

In other words, according to the embodiment shown in FIG. 6, when the second capacitor C2 (e.g., a voltage recovery capacitor) is charged with no less than a set voltage, the fourth switch is turned off. Therefore, power consumption due to inrush current is not generated or reduced.

The third resistor R3 is coupled between the diode D and the fourth switch SW4 to control a time for which a voltage (e.g., a predetermined voltage) is charged in the second capacitor C2 (e.g., a voltage recovery capacitor). That is, the value of the third resistor R3 is changed to change the time for which the voltage is charged in the second capacitor C2. Here, an inrush current corresponding to the voltage to be charged in the second capacitor C2 flows through the third resistor R3. Therefore, since the value of the third resistor R3 is small, the heat dissipation and the power consumption of the third resistor R3 do not significantly increase.

The diode D prevents reverse current from being generated when the second capacitor C2 charged at the energy recovery voltage Verc is charged by the first voltage V1 source.

Figure 7:
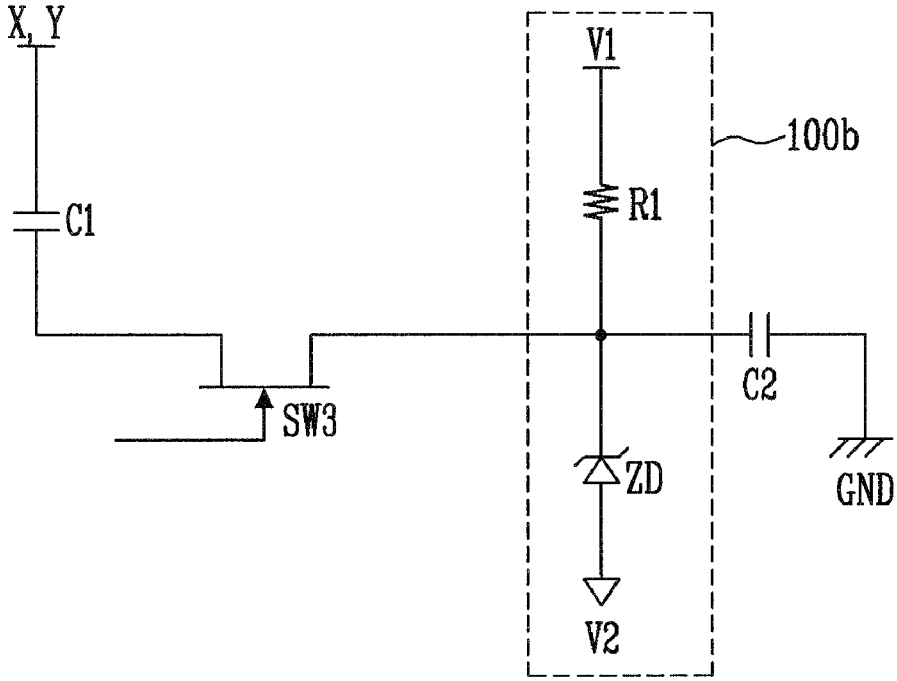
FIG. 7 is a schematic circuit diagram illustrating a precharger according to another embodiment of the present invention.

FIG. 7 is a schematic circuit diagram illustrating a precharging unit 100*b* according to another embodiment of the present invention.

Referring to FIG. 7, the energy recovery circuit includes the precharger 100*b*. The first capacitor C1, the second capacitor C2 and the third switch SW3 illustrated in FIG. 7 have the same structure as those in the circuit of FIG. 5.

The precharger 100*b* according to the embodiment of FIG. 7 includes a Zener diode ZD and a first resistor R1.

The Zener diode ZD maintains a Zener voltage (e.g., a predetermined constant voltage) when a current flows in a reverse-biased direction from a source at a voltage no less than the Zener voltage. Therefore, the energy recovery voltage Verc can be maintained by using the Zener diode ZD. For example, when the required energy recovery voltage Verc is 5V, the Zener diode ZD with a 5V Zener voltage is used. When a voltage applied to the Zener diode ZD is 6V, the voltage of 5V is maintained across the Zener diode ZD, and the remaining voltage of 1V may be dropped across a load resistor, for example.

The first resistor R1 is a load resistor for charging the second capacitor C2 charged with the energy recovery voltage Verc by the first voltage V1 source when the energy recovery voltage Verc is smaller than a required value. That is, the first resistor R1 serves as a load resistor to prevent the second capacitor C2 charged with the energy recovery voltage Verc from being excessively charged by the first voltage V1 source.

Figure 8:
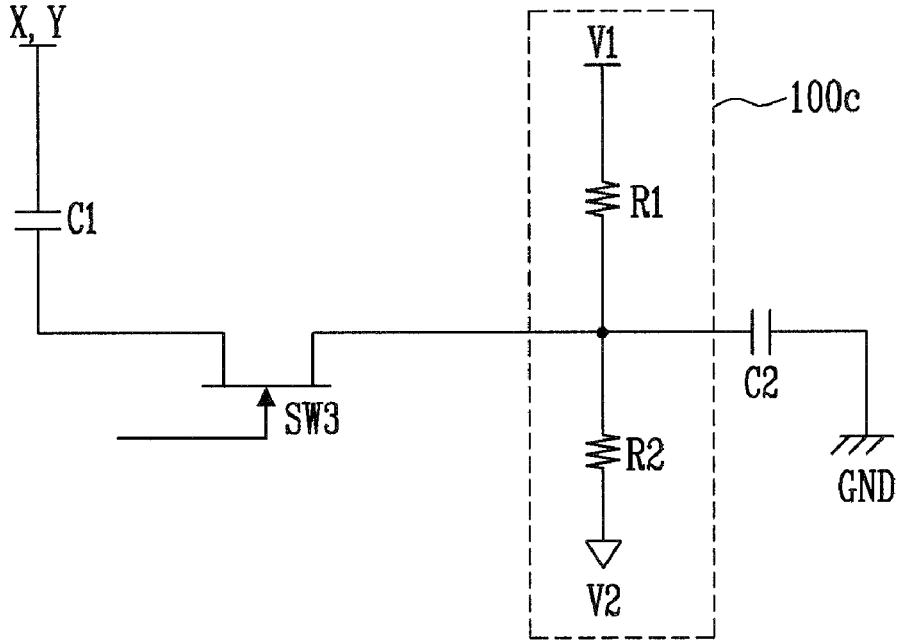
FIG. 8 is a schematic circuit diagram illustrating a precharger according to still another embodiment of the present invention.
Figure 9:
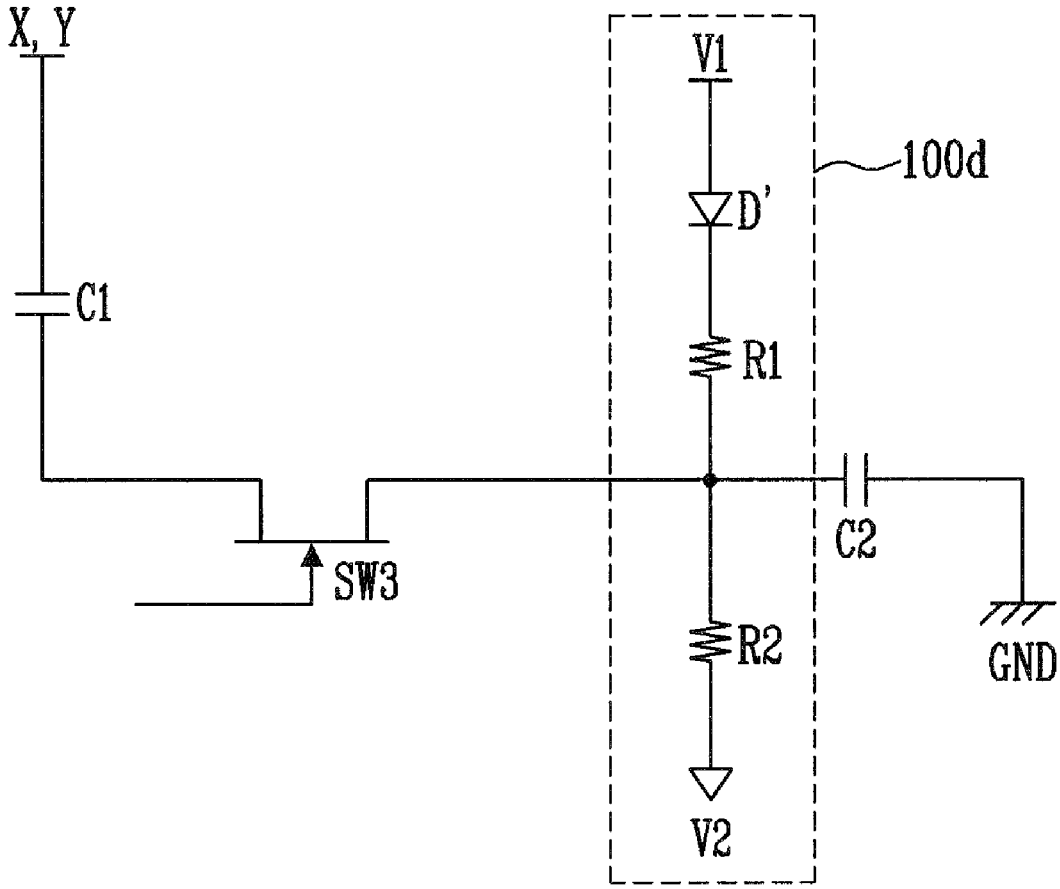
FIG. 9 is a schematic circuit diagram illustrating a precharger according to yet another embodiment of the present invention.

FIGS. 8 and 9 are schematic circuit diagrams illustrating prechargers according to other embodiments of the present invention.

The energy recovery circuits shown in FIGS. 8 and 9 include prechargers 100*c* and 100*d*, respectively. The first capacitor C1, the second capacitor C2 and the third switch SW3 illustrated in FIGS. 8 and 9 have the same structure as those in the circuit of FIG. 5.

The precharger 100*c* shown in FIG. 8 includes the first resistor R1 and the second resistor R2.

The first resistor R1 and the second resistor R2 are serially coupled between the first voltage V1 source and the second voltage V2 source to distribute a voltage.

For example, when the voltage level required as the energy recovery voltage Verc is 0.5V, the resistance value of the first resistor R1 is made equal to the resistance value of the second resistor R2 so that the energy recovery voltage Verc is 0.5V (e.g., assuming V1-V2 is equal to 1V).

According to the embodiment as illustrated in FIG. 9, a diode D' is further provided between the first voltage V1 source and the first resistor R1 to prevent reverse current from flowing to the first voltage V1 source.

In the plasma display device according to the described embodiments of the present invention, since the energy recovery voltage can be applied to all pixels regardless of whether the pixels are selected, it is possible to smoothly recover energy. In addition, since an amount of current (e.g., a predetermined amount of current) required during the address operation is received from the energy recovery capacitor and the precharger, it is possible to reduce the power consumption of a power source driver (SPMS). In addition, since the number of switching elements is reduced in comparison with the conventional technology, it is possible to reduce manufacturing cost.

Although exemplary embodiments of the present invention have been shown and described, it would be appreciated by those skilled in the art that changes might be made in the exemplary embodiments without departing from the principles and spirit of the invention, the scope of which is defined in the claims and their equivalents.

What is claimed is:

1. A plasma display device comprising a plasma display panel and an energy recovery circuit, the energy recovery circuit comprising:

first and second switches serially coupled between a first voltage source and a second voltage source;

a third switch directly coupled to a connection point between the first and second switches;

a voltage recovery capacitor between the third switch and a base voltage source, the voltage recovery capacitor comprising a terminal directly coupled to the third switch and being configured to recover a voltage from a panel capacitor of the plasma display panel;

a first resistor and a second resistor serially coupled between the first voltage source and a third voltage source to form a voltage distribution circuit;

a fourth switch having a control electrode coupled to a connection point between the first resistor and the second resistor, the fourth switch being coupled between the first voltage source and the voltage recovery capacitor; and a third resistor between the first voltage source and the fourth switch.

2. The plasma display device as claimed in claim 1, wherein the voltage distribution circuit is configured to apply a control voltage to the control electrode of the fourth switch.

3. The plasma display device as claimed in claim 2, wherein the fourth switch is turned off when a voltage difference between the control voltage and a voltage charged at the voltage recovery capacitor is less than a threshold voltage of the fourth switch.

4. A plasma display device comprising a plasma display panel and an energy recovery circuit, the energy recovery circuit comprising:

first and second switches serially coupled between a first voltage source and a second voltage source;

a third switch directly coupled to a connection point between the first and second switches;

a voltage recovery capacitor between the third switch and a base voltage source, the voltage recovery capacitor comprising a terminal directly coupled to the third switch and being configured to recover a voltage from a panel capacitor of the plasma display panel;

a first resistor between the first voltage source and the voltage recovery capacitor; and a Zener diode between the voltage recovery capacitor and the second voltage source, wherein the voltage recovery capacitor is configured to be kept charged with a voltage.

5. A plasma display device comprising a plasma display panel and an energy recovery circuit, the energy recovery circuit comprising:

first and second switches serially coupled between a first voltage source and a second voltage source;

a third switch directly coupled to a connection point between the first and second switches;

a voltage recovery capacitor between the third switch and a base voltage source, the voltage recovery capacitor comprising a terminal directly coupled to the third switch and being configured to recover a voltage from a panel capacitor of the plasma display panel;

a first resistor between the first voltage source and the voltage recovery capacitor; and a second resistor between the voltage recovery capacitor and the second voltage source.

6. The plasma display device as claimed in claim 5, further comprising a diode between the first voltage source and the first resistor.

7. A plasma display device comprising a plasma display panel and an energy recovery circuit, the energy recovery circuit comprising:

first and second switches serially coupled between a first voltage source and a second voltage source;

a third switch directly coupled to a connection point between the first and second switches;

a voltage recovery capacitor between the third switch and a base voltage source, the voltage recovery capacitor comprising a terminal directly coupled to the third switch and being configured to recover a voltage from a panel capacitor of the plasma display panel; and a precharger coupled to a connection point between the third switch and the voltage recovery capacitor.

8. The plasma display device as claimed in claim 7, wherein the precharger comprises:

a first resistor between the first voltage source and the voltage recovery capacitor; and a Zener diode between the voltage recovery capacitor and the second voltage source, wherein the voltage recovery capacitor is configured to be kept charged with a voltage.

9. The plasma display device as claimed in claim 7, wherein the precharger comprises:

a first resistor between the first voltage source and the voltage recovery capacitor; and a second resistor between the voltage recovery capacitor and the second voltage source.

10. The plasma display device as claimed in claim 9, wherein the precharger further comprises a diode between the first voltage source and the first resistor.

11. The plasma display device as claimed in claim 7, wherein the precharger comprises:

a first resistor and a second resistor serially coupled between the first voltage source and a third voltage source to form a voltage distribution circuit;

a fourth switch having a control electrode coupled to a connection point between the first resistor and the second resistor, the fourth switch being between the first voltage source and the voltage recovery capacitor; and a third resistor between the first voltage source and the fourth switch.

12. The plasma display device as claimed in claim 11, wherein the voltage distribution circuit is configured to apply a control voltage to the control electrode of the fourth switch.

13. The plasma display device as claimed in claim 12, wherein the fourth switch is turned off when a voltage difference between the control voltage and a voltage charged at the voltage recovery capacitor is less than a threshold voltage of the fourth switch.

* * * * *